United States Patent [19]

Cretin

[11] 4,211,029

[45] Jul. 8, 1980

[54] SAFETY PYRAMID TOY SPINDLE

[76] Inventor: Michel Cretin, Maisod, 39260 Moirans-en-Montagne, France

[21] Appl. No.: 870,122

[22] Filed: Jan. 17, 1978

[30] Foreign Application Priority Data

Jan. 21, 1977 [FR] France ..... 77 02339

[51] Int. Cl.[2] ..... A63H 33/00

[52] U.S. Cl. ..... 46/17

[58] Field of Search ..... 46/16, 1 R, 17, 22, 46/32; 273/157 R, 153 P

[56] References Cited

U.S. PATENT DOCUMENTS

| | | | |
|---|---|---|---|
| 702,615 | 6/1902 | Barden | 273/157 R |
| 2,475,306 | 7/1949 | Beder | 46/22 |
| 2,725,234 | 11/1955 | Coble et al. | 273/157 R |
| 3,503,832 | 3/1970 | Umminger | 46/17 X |
| 3,721,446 | 3/1973 | Young | 273/157 R |
| 3,745,694 | 7/1973 | Vennola | 46/16 |
| 3,940,877 | 3/1976 | Culkin | 46/22 X |

*Primary Examiner*—F. Barry Shay

*Attorney, Agent, or Firm*—Robert E. Burns; Emmanuel J. Lobato; Bruce L. Adams

[57] ABSTRACT

On this safety pyramidal toy spindle fitted in a separate base similar components formed with a central hole are adapted to be placed in order to constitute an educational game for small children; the pyramid formed by the components being crowned by an allegorical head or similar character. This spindle is a one-piece member of non-toxic material having a flexibility sufficient to permit the bending of its tip down to the level of the base bottom, the spindle resuming its position substantially perpendicular to the base when the pressure exerted at any point along the spindle is released. The cross-sectional shape of the spindle being substantially that of a greek cross with reinforcing ribs.

8 Claims, 5 Drawing Figures

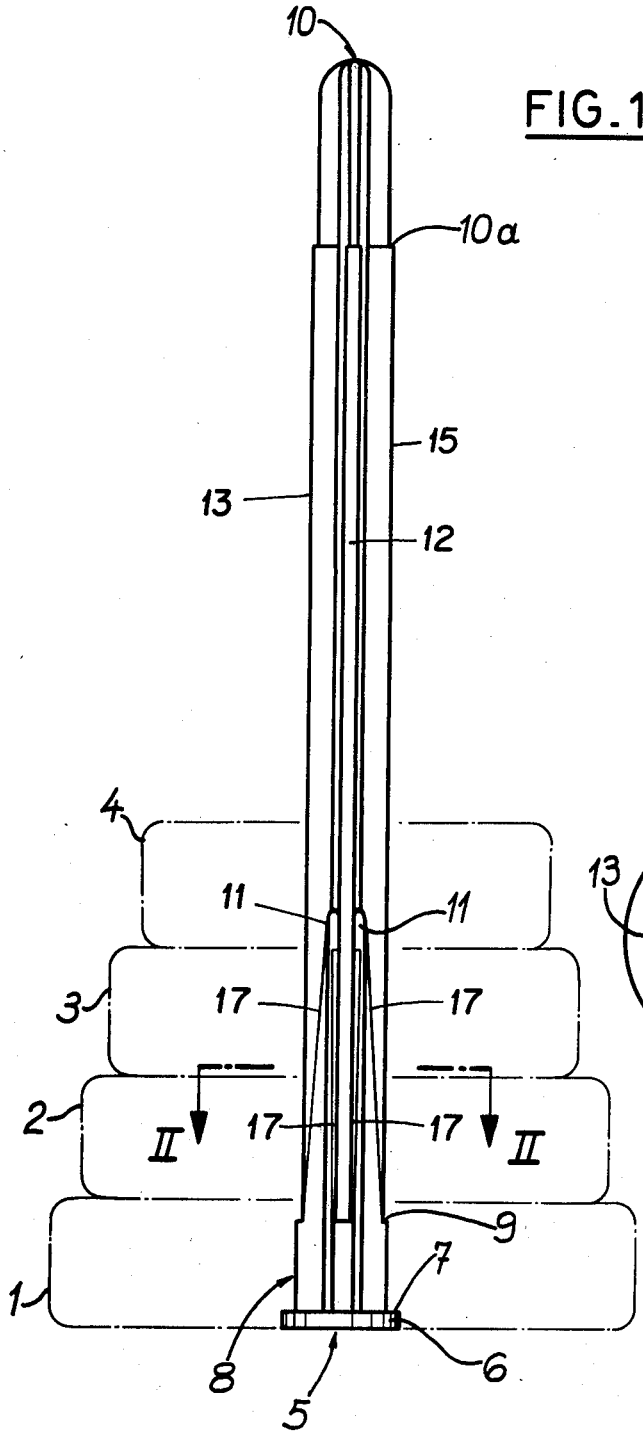
FIG. 1
FIG. 2
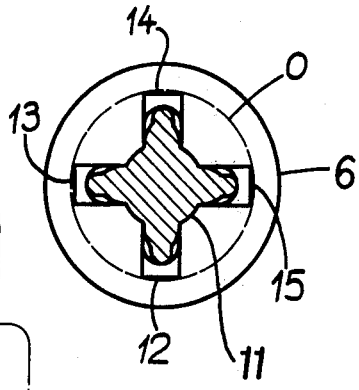

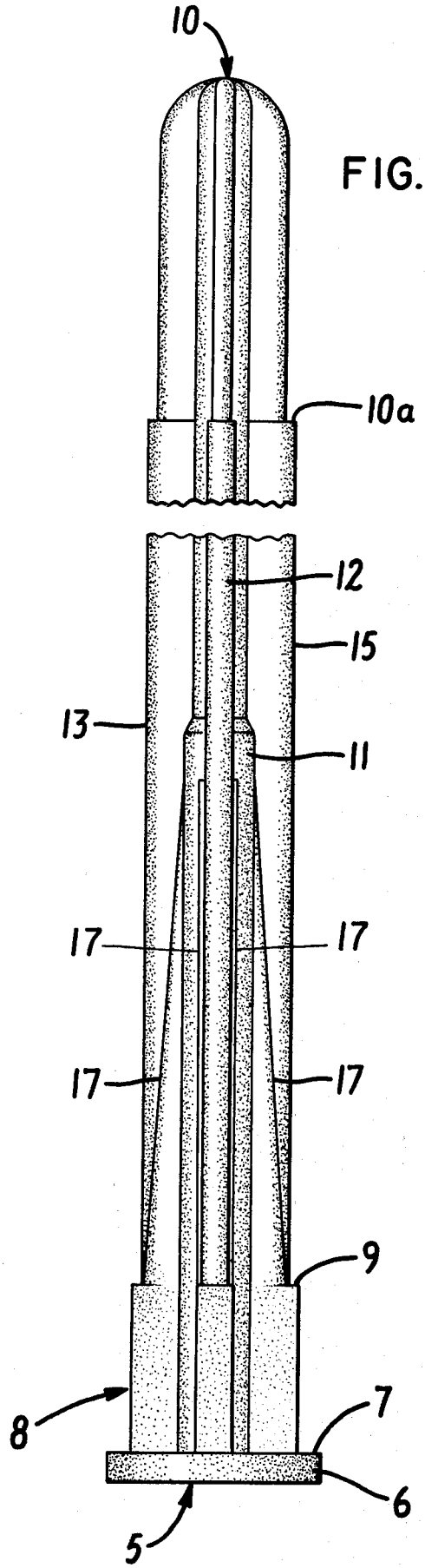
FIG. 4
FIG. 5
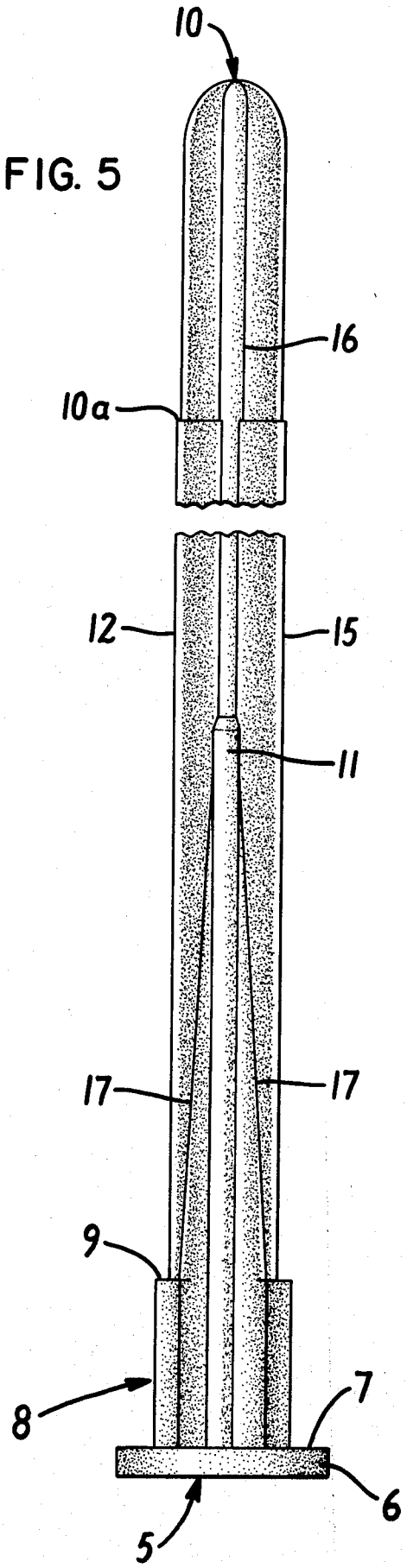

SAFETY PYRAMID TOY SPINDLE

FIELD OF THE INVENTION

The present invention relates in general to toys of the so-called "Russian Pyramid" type comprising an independent flat base supporting an upstanding spindle on to which a number of similar components formed with a central holes are adapted to be stacked. This toy is intended for very young children, and may comprise at the top of the stack an allegorical head or other character.

Toys of this type are in general use throughout the world and intended for developing in the child the notion of a construction that he can build by himself, the final result, resembling roughly to a pyramid, arising in general the child's interest.

To facilitate the child's movements, this construction comprises a relatively stable and substantially flat base to which the spindle constituting the spine of the toy is secured. Thus, by stacking on to this spindle a plurality of components formed with a central through hole, the child can build his first "structure".

DESCRIPTION OF THE PRIOR ART

Hitherto known toys of this character comprise a rigid or semi-rigid wooden or plastic spindle and this rigidity is highly objectionable since the child may hurt himself in case of fall.

DESCRIPTION OF THE INVENTION

It is the essential object of the present invention to provide, in a toy of the general type described hereinabove, a spindle characterized in that it consists of a single rod-like member made from a suitable nontoxic material and having a cross-sectional designed to impart thereto a substantial flexibility, at least sufficient to enable the tip of the spindle to be bent down to the base level and to resume a position substantially perpendicular to said base when the pressure exerted at any desired point along said spindle is released.

This toy spindle is advantageous in that it meets the safety regulations in force in most countries for toys, without inasmuch inpairing the constructional facility constituting the primary requirement of a toy of this character.

DESCRIPTION OF THE DRAWING

FIG. 1 is an elevational view of the spindle according to this invention, fitted to its base and on to which a plurality of components shown in phantom lines are placed;

FIG. 2 is a cross-section taken on a larger scale along the line II—II of FIG. 1.

FIG. 4 is an elevational view of the spindle removed from the base;

FIG. 5 is an elevational view of the spindle turned 45° from the view shown in FIG. 4.

DESCRIPTION OF THE PREFERRED EMBODIMENT

Figure 3:
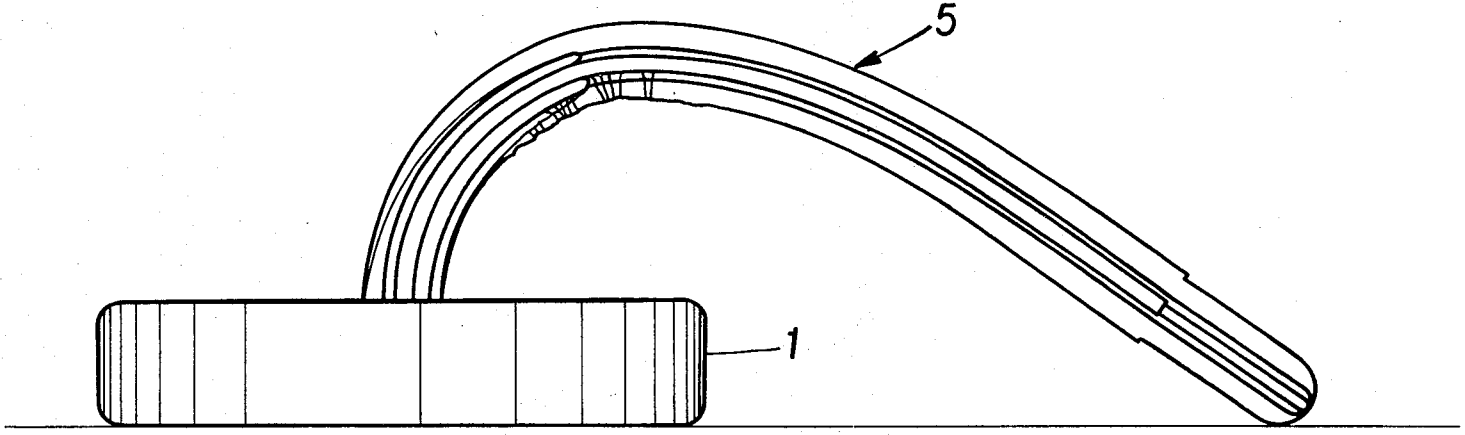
FIG. 3 is an elevational view showing the spindle and base assembly, the spindle being bent so that its tip be level with the bottom of the base.

Referring to FIG. 1, there is shown diagrammatically therein a pyramid toy comprising a base 1 and components 2,3,4 . . . (shown only in phantom lines) formed with a central passing hole and placed on a spindle 5 constituting the spine of the construction. If the base 1 is intended to have a shape and dimensions capable of imparting a certain stability to the assembly, the components 2,3,4 . . . may have different configurations, such as flat washers, discs, spherical or ball-shaped elements, semispherical elements, ovoidal elements, tapered elements, etc., provided that they are substantially symmetrical in relation to the central through hole.

This hole should preferably have a diameter slightly greater than that of the circle (0) in which a cross-section of spindle 5 is inscribed (FIG. 2). At least during a first period during which he learns how to use the toy, the child should preferably not have to abide by any predetermined order for stacking the components 2,3,4 . . . , otherwise he would find the game too difficult and rapidly cease to take further interest therein.

The spindle 5 comprises a relatively thin circular bottom flange 6 of a diameter slightly greater than that of circle (0), to prevent the spindle 5 from penetrating into base 1 beyond a predetermined level determined by an inner shoulder 7 formed in the central hole 8 of the base, as shown in FIG. 1.

In addition, this spindle 5 has a shoulder 9 formed short of the upper surface of base 1 for reinforcing the fitting thereof in the base hole 1.

The upper end section of spindle 5 comprises a rounded tip 10 and has a relatively short length, with a diameter slightly smaller than the remaining part of the spindle, in order to facilitate the fitting in position of the allegorical head or other character usually provided for crowning the finished construction.

Another shoulder 10*a* terminates this short length and determines the limit for inserting said allegorical head or similar character on to the spindle 5.

According to one of the essential features of this invention, the spindle 5 is made from non-toxic material having a considerable elasticity, so that children can suck or pretend to bite the spindle without any risk, as they do naturally during the period in which their teeth emerge from their gums. Moreover, this elasticity is sufficient to prevent any damages to the child's gums, and the spindle material is neutral and tasteless, with a smooth surface free of any unevenness likely to retain microbial elements. Furthermore, this spindle can be cleaned and disinfected by applying conventional methods, without requiring particular cares.

More particularly, the elasticity of spindle 5 is such that it can be bent to the position shown in FIG. 3, i.e. with its tip 10 level with the bottom of base 1; when released, the spindle will resume its original position substantially at right angles to the base 1.

In order to facilitate the return of the bent and released spindle to its normal upstanding position shown in FIG. 1, the cross-section of the spindle illustrated in the drawing has the shape of a Greek cross with a central core portion and four radial arms 12, 13, 14 and 15 as shown in FIG. 2. Between the bases of the arms, there are small rounded fillets 16 which avoid the formation of grooves which might collect dirt. To increase the tendency of spindle 5 to resume its normal position (FIG. 1), a reinforcement in the form of ribs 11 fitted into each inner corner formed between adjacent arms 12, 13, 14 and 15 of the Greek cross may be provided along a certain length above the base flange 6 and caused to adhere to the inner surface of each groove formed between said arms 12, 13, 14 and 15. Moreover each of the arms 12–15 has tapered thickened portions 17 which extend down from near the tops of ribs 11 and increase progressively in width as seen in FIGS. 1, 3 and 4.

Above the level attained by the top of said ribs 11, the reinforcement of spindle 5 consists of a small semi-circular filling 16 engaging each inner corner of the Greek cross. In other words, the spindle 5 consists of a central core or cylinder of relatively small diameter with a very slight taper from the base flange 6 to the tip 10, from which arms 12,13,14,15 of identical length extend radially along two perpendicular diameters.

With this particular arrangement, the spindle flexibility increases from bottom to top.

This spindle 5 may also consist, if desired, of a cylinder of which the diameter decreases from bottom to top in order to facilitate the superposition of pyramid components 2,3,4 . . .

In a modified form of embodiment, the cylinder mentioned hereinabove may comprise fins or ribs for reducing the diameter and weight thereof while increasing its flexibility.

In order to preserve a necessary symmetry, the fins or ribs should preferably be inscribed in a circle of a diameter slightly inferior to that of the holes 8 of the pyramid components 2,3,4 . . .

The spindle 5 may have any other geometrical configuration, for example a square, lozenge, triangular, twisted, braided cross-sectional shape, etc., without interfering with the advantages resulting from the invention, provided however that this shape be symmetrical in relation to a geometrical axis coincident with the center of the base.

A typical example of a material suitable for use in the manufacture of the spindle according to the present invention is a non-toxic thermoplastic elastomer manufactured in conformity with hygienic regulations.

What is claimed is:

1. A safety toy comprising a base having a central hole with an annular recess around said hole on the lower face of said base, and a flexible spindle of non-toxic resilient material snugly received in said hole of the base and having a flange received in said recess, said spindle having a rounded tip and tapering from said base to said tip, with a cross sectional shape comprising a central core portion and a plurality of arms radiating from said core portion, said arms having rounded extremities, the flexibility of said spindle being sufficient to permit bending the tip of said spindle down to the level of the base and the resiliency of the material being sufficient to cause said spindle to resume its initial position substantially normal to the base when released.

2. A safety toy according to claim 1, in which the portion of said spindle received in said hole in the base is of larger cross section than portions of said spindle above the base and terminates in a shoulder formed short of the upper face of said base.

3. A safety toy according to claim 2, in which said arms have tapered thickened portions extending upwardly from said shoulder.

4. A safety toy according to claim 1, in which the cross sectional shape of said spindle includes small fillets between adjacent ones of said arms to avoid dirt-collecting grooves.

5. A safety toy according to claim 4, in which said spindle has ribs which are between said arms and extend upwardly from said flange.

6. A safety toy according to claim 1, further comprising a plurality of components having holes to receive said spindle and stacked on said spindle above said base.

7. A safety toy according to claim 1, in which said spindle has the cross sectional shape of a Greek cross with four of said arms.

8. A safety toy according to claim 1, in which said spindle has a smaller upper end portion which facilitates insertion of the spindle into a toy component having a hole to receive the spindle.

* * * * *